US008925276B2

(12) United States Patent
Qin

(10) Patent No.: US 8,925,276 B2
(45) Date of Patent: Jan. 6, 2015

(54) WALL BLOCK, CORNER, AND WALL BODY

(75) Inventor: Shengyi Qin, Beijing (CN)

(73) Assignee: Beijing Rechsand Science & Technology Group Co., Ltd. (CN)

( * ) Notice: Subject to any disclaimer, the term of this patent is extended or adjusted under 35 U.S.C. 154(b) by 0 days.

(21) Appl. No.: 13/989,812

(22) PCT Filed: Oct. 31, 2011

(86) PCT No.: PCT/CN2011/081542

§ 371 (c)(1),
(2), (4) Date: Sep. 16, 2013

(87) PCT Pub. No.: WO2012/068945

PCT Pub. Date: May 31, 2012

(65) Prior Publication Data

US 2013/0340372 A1 Dec. 26, 2013

(30) Foreign Application Priority Data

Nov. 26, 2010 (CN) ..... 2010 1 0574412
Nov. 26, 2010 (CN) ..... 2010 1 0574414
Dec. 20, 2010 (CN) ..... 2010 1 0595232

(51) Int. Cl.

| | |
|---|---|
| ***E04B 5/04*** | (2006.01) |
| ***E04C 2/04*** | (2006.01) |
| ***E04B 2/16*** | (2006.01) |
| ***E04B 2/42*** | (2006.01) |
| ***E04B 2/44*** | (2006.01) |
| ***E04C 1/39*** | (2006.01) |
| ***E04B 2/54*** | (2006.01) |
| *E04B 2/02* | (2006.01) |

(52) U.S. Cl.

CPC ... *E04B 2/16* (2013.01); *E04B 2/42* (2013.01); *E04B 2/44* (2013.01); *E04C 1/395* (2013.01); *E04B 2/54* (2013.01); *E04B 2002/0215* (2013.01)

USPC ..... 52/606; 52/572; 52/592.6; 52/604

(58) Field of Classification Search

CPC ..... E04B 2/42; E04B 2/44; E04B 2/54; E04B 2/14; E04B 2002/0215; E04B 2002/0206; E04B 2/18; E04C 1/395; E04C 1/40; E02D 29/25

USPC ..... 52/421, 422, 561, 572, 592.6, 604, 606

See application file for complete search history.

(56) References Cited

U.S. PATENT DOCUMENTS 2,610,503 A * 9/1952 Hall ..... 52/592.3
4,091,587 A 5/1978 Depka (Continued)

FOREIGN PATENT DOCUMENTS

CN 1189565 A 8/1998
CN 1587568 A 3/2005

(Continued)

OTHER PUBLICATIONS

Definition of centrosymmetric provided by dictionary.com.*

(Continued)

*Primary Examiner* — Brian Glessner
*Assistant Examiner* — Brian D Mattei
(74) *Attorney, Agent, or Firm* — Morriss O'Bryant Compagni, PC

(57) ABSTRACT

The present invention provides a wall block. The wall block (1) comprises a first wall (11), a second wall (12), a third wall (13) and a rib (14), wherein the first wall (11) is in parallel with the second wall (12), the third wall (13) is securely connected between the two walls, at the two respective ends of the two walls; the rib (14) is connected fixedly between the first wall (11) and the second wall (12), and forms a hollow portion (17) with the third wall (13). With the technical solution, as the wall block has a hollow structure, a load-bearing structure (such as a bearing pillar) may be arranged directly in the hollow structure of the wall block, unlike the traditional wall blocks which need to be piled up around the load-bearing structure (such as a bearing pillar) at a large amount. Therefore, the wall block of the present invention can save time for piling up the same and improve construction efficiency.

24 Claims, 9 Drawing Sheets

(56) References Cited

U.S. PATENT DOCUMENTS

| | | | | |
|---|---|---|---|---|
| 4,107,894 | A * | 8/1978 | Mullins | 52/592.6 |
| 4,186,540 | A * | 2/1980 | Mullins | 52/592.6 |
| 4,833,852 | A * | 5/1989 | West | 52/405.1 |
| 5,575,128 | A * | 11/1996 | Haener | 52/572 |
| 5,802,797 | A * | 9/1998 | Storer-Folt | 52/604 |
| 6,226,951 | B1 * | 5/2001 | Azar | 52/604 |
| 2006/0104726 | A1 * | 5/2006 | Carey et al. | 405/286 |
| 2008/0098934 | A1 * | 5/2008 | Kwak et al. | 106/711 |
| 2008/0134616 | A1 | 6/2008 | Craven et al. | |
| 2008/0148676 | A1 * | 6/2008 | Azar | 52/604 |
| 2008/0319106 | A1 * | 12/2008 | Mercier et al. | 524/5 |
| 2009/0217610 | A1 * | 9/2009 | Curtis | 52/309.12 |
| 2010/0071597 | A1 * | 3/2010 | Perez-Pena | 106/708 |

FOREIGN PATENT DOCUMENTS

| | | | |
|---|---|---|---|
| CN | 201896392 | U | 7/2011 |
| CN | 201896393 | U | 7/2011 |
| CN | 201972294 | U | 9/2011 |

OTHER PUBLICATIONS

Definition of centrosymmetric provided by dictionary.com, printed on Jan. 1, 2014.*

* cited by examiner

WALL BLOCK, CORNER, AND WALL BODY

CROSS-REFERENCE TO RELATED APPLICATIONS

This application is a national phase entry under 35 U.S.C. §371 of PCT/CN2011/081542 filed on Oct. 31, 2011, which claims priority to Chinese Patent Application No. 201010574412.8 filed on Nov. 26, 2010 and Chinese Patent Application No. 201010574414.7 filed on Nov. 26, 2010 and Chinese Patent Application No. 201010595232.8 filed on Dec. 20, 2010, the entirety of each of which is incorporated by this reference.

TECHNICAL FIELD

The present invention relates to a field of building construction, in particular to a hollow wall block. Furthermore, the present invention also relates to a wall corner constructed by piling up wall blocks mentioned above.

BACKGROUND ART

Generally speaking, the process of constructing a building comprises firstly forming a load-bearing structure of a building by means of pouring; then piling up wall blocks by using the load-bearing structure as a framework, to form an appended structure, such as a wall body; finally, completing the construction of the building.

However, as a traditional wall block is mainly of solid structure, when constructing an appended structure by piling up traditional wall blocks, a large number of such wall blocks need to be piled up to surround the load-bearing structure (such as a bearing pillar), which leads to an extended construction time and a reduced working efficiency.

Therefore, it becomes the technical problem to be immediately solved in the art that how to save time for piling up wall blocks so as to enhance the construction efficiency.

CONTENTS OF THE INVENTION

An object of the present invention is to provide a wall block which may save the time for stacking and enhance the construction efficiency.

Furthermore, the present invention also relates to a wall corner and a wall body constructed by piling up the wall blocks mentioned-above.

According to a first embodiment of the present invention, it provides a wall block comprising a first wall, a second wall, a third wall and a rib. The first wall is in parallel with the second wall. The third wall is securely connected between the first wall and the second wall, at two respective ends of the two walls. The rib is securely connected between the first wall and the second wall, and forms a hollow portion with the third wall.

Preferably, the wall block may comprise an opening portion arranged between the first wall and the second wall. Further, the rib is arranged between the opening portion and the hollow portion.

Preferably, the first wall, the second wall, the third wall and the rib have the same height, and the upper surfaces of the third wall and of the rib are flush with the upper surfaces of the first wall and of the second wall.

Preferably, a recess is arranged on the upper surface and/or the lower surface of the rib.

Preferably, the cross section of the recess is in a shape of ladder.

Preferably, the depth of the recess is 1/10-1/5 of the height of the rib.

Preferably, the wall block has a symmetrical structure in both the width direction and the height direction, and the surface of the third wall towards the hollow portion and the surface of the rib towards the hollow portion are both perpendicular to the length direction of the first wall.

Preferably, the shapes of the hollow portion and the opening portion are rectangle, and the length of the opening portion is 1/3-2/3 of the length of the hollow portion.

Preferably, the wall block is formed by curing a material combination. The material combination may contain silicon sand, cement, water reducing agent, re-dispersible emulsion powder, fiber and water therein; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

Preferably, the fiber is one or more selected from synthetic fiber, inorganic fiber, mineral fiber and plant fiber. The fiber length is 1-30 mm, and the average diameter is 0.1-100 μm.

Preferably, the re-dispersible emulsion powder is one or more selected from the copolymerized emulsion powder of vinylacetate and ethylene, the terpolymerized emulsion powder of ethylene, vinyl chloride and vinyl laurate, the copolymerized emulsion powder of acrylic ester and styrene, and the copolymerized emulsion powder of styrene and butadiene. The weight-average molecular weight of the re-dispersible emulsion powder is 500-20000, and the average particle diameter is 1-300 μm.

Preferably, the average particle diameter of the silicon sand is 10-500 μm.

Preferably, the water reducing agent is one or more selected from lignosulfonate, polycyclic aromatic salt and water soluble resin sulfonate.

The present invention provides a wall corner comprising a plurality of said wall blocks stacked one by one in the height direction. Any two wall blocks adjacent to each other in the height direction are mutually perpendicular with each other in length direction, so as to form a vertical through hole inside the wall corner.

According to a second embodiment of the present invention, it provides a wall block comprising a first wall and a second wall parallel with each other, as well as a first rib and a second rib which are securely connected between the first wall and the second wall; the first rib and the second rib form a hollow portion therebetween. The wall block further comprises a first opening portion and a second opening portion which are arranged between the first wall and the second wall; the first rib is arranged between the first opening portion and the hollow portion, and the second rib is arranged between the second opening portion and the hollow portion.

Preferably, the first rib, the second rib, the first wall and the second wall have the same height. The upper surfaces of the first rib and of the second rib are flush with the upper surfaces of the first wall and of the second wall.

Preferably, a recess is arranged on the upper surface and/or the lower surface of the first rib, and a recess is arranged on the upper surface and/or the lower surface of the second rib.

Preferably, the cross section of the recess is in a shape of ladder.

Preferably, the depth of the recess is 1/10-1/5 of the height of the first rib.

Preferably, the wall block has a centrosymmetric structure, and the surface of the first rib towards the hollow portion and the surface of the second rib towards the hollow portion are perpendicular to the length direction of the first wall.

Preferably, the hollow portion, the first opening portion and the second opening portion each has a rectangular shape, and the length of each of the first opening portion and the second opening portion is ⅓-⅔ of the length of the hollow portion.

Preferably, the wall block is formed by solidification of a material combination. The material combination may contain silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

Preferably, the fiber is one or more selected from synthetic fiber, inorganic fiber, mineral fiber and plant fiber. The fiber length is 1-30 mm, and the average diameter is 0.1-100 μm.

Preferably, the re-dispersible emulsion powder is one or more selected from the copolymerized emulsion powder of vinylacetate and ethylene, the terpolymerized emulsion powder of ethylene, vinyl chloride and vinyl laurate, the copolymerized emulsion powder of acrylic ester and styrene, and the copolymerized emulsion powder of styrene and butadiene. The weight-average molecular weight of the re-dispersible emulsion powder is 500-20000, and the average particle diameter is 1-300 μm.

Preferably, the average particle diameter of the silicon sand is 10-500 μm.

Preferably, the water reducing agent is one or more selected from lignosulfonate, polycyclic aromatic salt and water soluble resin sulfonate.

The present invention provides a wall body comprising a plurality of said wall blocks stacked one by one in both the length direction and the height direction to form a vertical through hole inside the wall body.

According to a third embodiment of the present invention, it provides a wall block comprising a first wall and a second wall parallel with each other, as well as a first rib and a second rib which are securely connected between the first wall and the second wall; the first rib and the second rib form a hollow portion therebetween. The wall block further comprises a first flange arranged on one side of the first wall towards the hollow portion and/or one side of the second wall towards the hollow portion.

Preferably, the upper surface of the first flange is flush with the upper surface(s) of the first wall and/or the second wall.

Preferably, the first flange extends over the entire length of the first wall and/or the second wall, in the length direction of the wall block.

Preferably, the width of the first flange is 1/10-¼ of the width of the hollow portion.

Preferably, the wall block comprises a first opening portion arranged between the first wall and the second wall; and the first rib is arranged between the first opening portion and the hollow portion.

Preferably, the wall block further comprises a second flange arranged on one side of the first rib towards the hollow portion and/or one side of the first rib towards the first opening portion.

Preferably, the wall block further comprises a second opening portion arranged between the first wall and the second wall; and the second rib is arranged between the second opening portion and the hollow portion.

Preferably, the wall block further comprises a third flange arranged on one side of the second rib towards the hollow portion and/or one side of the second rib towards the second opening portion.

Preferably, the wall block further comprises a first protruding portion and/or a first recessed portion, which are/is arranged on at least one surface of the upper surface and the lower surface of the wall block.

Preferably, the wall block further comprises a second protruding portion and/or a second recessed portion, which are/is arranged on at least one end surface of two end surfaces of the wall block, in the length direction of the wall block.

Preferably, a longitudinal strengthening rib extending along the length direction of the wall block is arranged inside the first wall and/or the second wall, and a transverse strengthening rib extending along the width direction of the wall block is arranged inside the first rib and/or the second rib; the longitudinal strengthening rib and the transverse strengthening rib are connected securely or formed integrally.

Preferably, the wall block is formed by curing a material combination. The material combination may contain silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

Preferably, the fiber is one or more selected from synthetic fiber, inorganic fiber, mineral fiber and plant fiber. The fiber length is 1-30 mm, and the average diameter is 0.1-100 μm.

Preferably, the re-dispersible emulsion powder is one or more selected from the copolymerized emulsion powder of vinylacetate and ethylene, the terpolymerized emulsion powder of ethylene, vinyl chloride and vinyl laurate, the copolymerized emulsion powder of acrylic ester and styrene, and the copolymerized emulsion powder of styrene and butadiene. The weight-average molecular weight of the re-dispersible emulsion powder is 500-20000, and the average particle diameter is 1-300 μm. The water reducing agent is one or more selected from lignosulfonate, polycyclic aromatic salt and water soluble, resin sulfonate.

Preferably, the average particle diameter of the silicon sand is 10-500 μm.

With the technical solutions mentioned above, as the wall block has a hollow structure, the load-bearing structure (such as a bearing pillar) may be arranged directly within the hollow structure of the wall block, unlike the traditional solid wall blocks which need to be piled up around the load-bearing structure (such as a bearing pillar) at a large amount. Therefore, the wall block provided in the present invention may save the time for piling up and enhance the construction efficiency.

Other technical features and the beneficial effects of the present invention will be illustrated in details in the following particular embodiments.

BRIEF DESCRIPTION OF THE DRAWINGS

The accompanying drawings are provided for further understanding the present invention, and constitute one part of the specification, to explain the present invention in conjunction with the following particular embodiments, but not to limit the present invention. In the accompanying drawings.

LIST FOR REFERENCE NUMBERS

Figure 1:
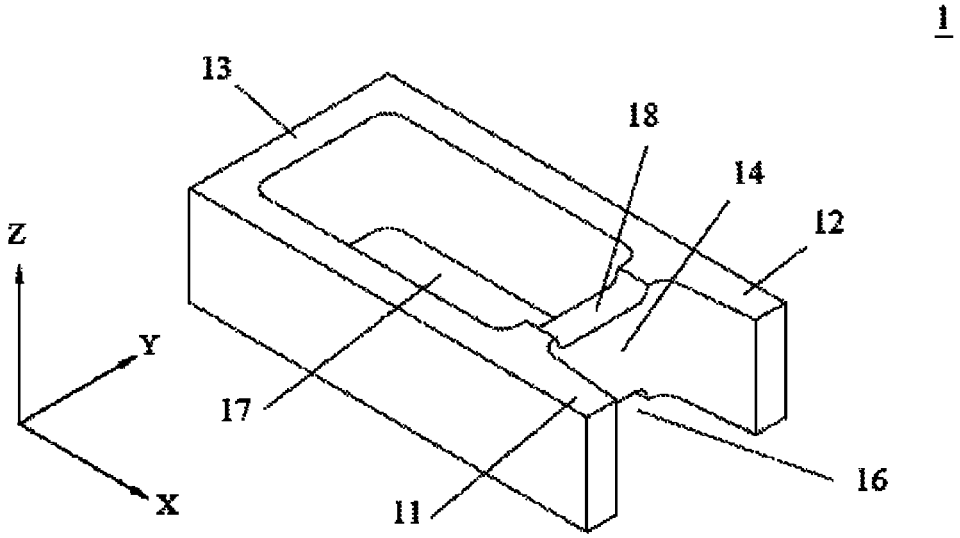
FIG. 1 is a perspective structural schematic diagram of the wall block according to a first embodiment of the present invention.

1, 2 a wall block
11, 12, 31 a first wall
13 a third wall
14 a rib
16 an opening portion
17, 27, 37 a hollow portion
18, 28, 38 a recessed portion
23, 33 a first rib
24, 34 a second rib
25, 35 a first opening portion
26, 36 a second opening portion
30 a longitudinal strengthening rib
39 a transverse strengthening rib
a a first flange
b a first protruding portion
c a first recessed portion
H a vertical through hole

SPECIFIC MODE FOR CARRYING OUT THE INVENTION

The particular embodiments of the present invention will be described in details in combination with the accompanying drawings. It should be understood that the particular embodiments described herein are only for the purpose of illustration and explanation, but not of limitations to the present invention.

First Embodiment

In this embodiment, the length direction is the X direction in FIG. 1, the width direction is the Y direction in FIG. 1, and the height direction is the Z direction in FIG. 1. The upper surfaces are the surfaces of the first wall 1 and of the second wall 2 which are facing upwards, and the lower surfaces are the surfaces of the first wall 1 and of the second wall 2 which are facing downwards, as shown in FIG. 1.

As shown in FIG. 1, this embodiment provides a wall block comprising a first wall 11, a second wall 12, a third wall 13 and a rib 14. The first wall 11 is in parallel with the second wall 12. The third wall 13 is securely connected to the first wall 11 and the second wall 12, at two respective ends of the two walls. The rib 14 is securely connected between the first wall 11 and the second wall 12, and forms a hollow portion 17 with the third wall 13.

With the technical solution mentioned above, as the wall block has a hollow structure, the load-bearing structure (such as a bearing pillar) may be arranged directly within the hollow structure of the wall block, unlike the traditional solid wall blocks which need to be piled up around the load-bearing structure (such as a bearing pillar) at a large amount. Therefore, the wall block provided in the present invention may save the time for piling up the same and enhance the construction efficiency.

The first wall 11 and the second wall 12 are in parallel with each other so that a wall body can be easily formed as a plane by piling up wall blocks, which facilitates the proceeding of subsequent process, such as finishing. The third wall 13 and the rib 14 are securely connected between the first wall 11 and the second wall 12 to form a hollow structure. Meanwhile, securely connecting may further enhance the strength of the wall block so that the wall block has higher durability. The first wall 11, the second wall 12, the third wall 13 and the rib 14 are securely connected together by various ways, such as by bonding with a binding agent. Apparently, for convenient manufacture and reduced cost, the first wall 11, the second wall 12, the third wall 13 and the rib 14 are preferably formed integrally, by means of, for example, pouring.

As shown in FIG. 1, the wall block preferably comprises an opening portion 16 arranged between the first wall 11 and the second wall 12; and the rib 14 is arranged between the opening portion 16 and the hollow portion 17. During piling up wall blocks, the opening portion 16 may align with an opening portion of the other wall block, to form a space for arranging a bearing pillar. The wall body constructed by piling up such wall blocks has passages inside, which are communicated with each other, and the concrete or the thermal insulation material can be distributed within the wall body uniformly during pouring the concrete or filling the thermal insulation material, so as to enhance the strength of the wall body or the thermal insulation effect.

Preferably, the first wall 11, the second wall 12, the third wall 13 and the rib 14 have the same height. The upper surfaces of the third wall 13 and of the rib 14 are flush with the upper surfaces of the first wall 11 and of the second wall 12. Such wall block facilitates manufacture and transportation as well as piling up the same.

At the same time, the wall body constructed by piling up such wall blocks, of which the upper surface is flush with the lower surface, has higher strength.

As shown in FIG. 1, a recess 28 is preferably arranged on the upper surface and/or the lower surface of the rib 14. Such structure is arranged not only to save the material, but also to reduce the weight of the wall block. Furthermore, a bearing pillar may be arranged at the recess 28 in the length direction (i.e. the X direction) of the wall block, if necessary, so that the strength of the wall body constructed by piling up the wall blocks is enhanced.

Figure 3:
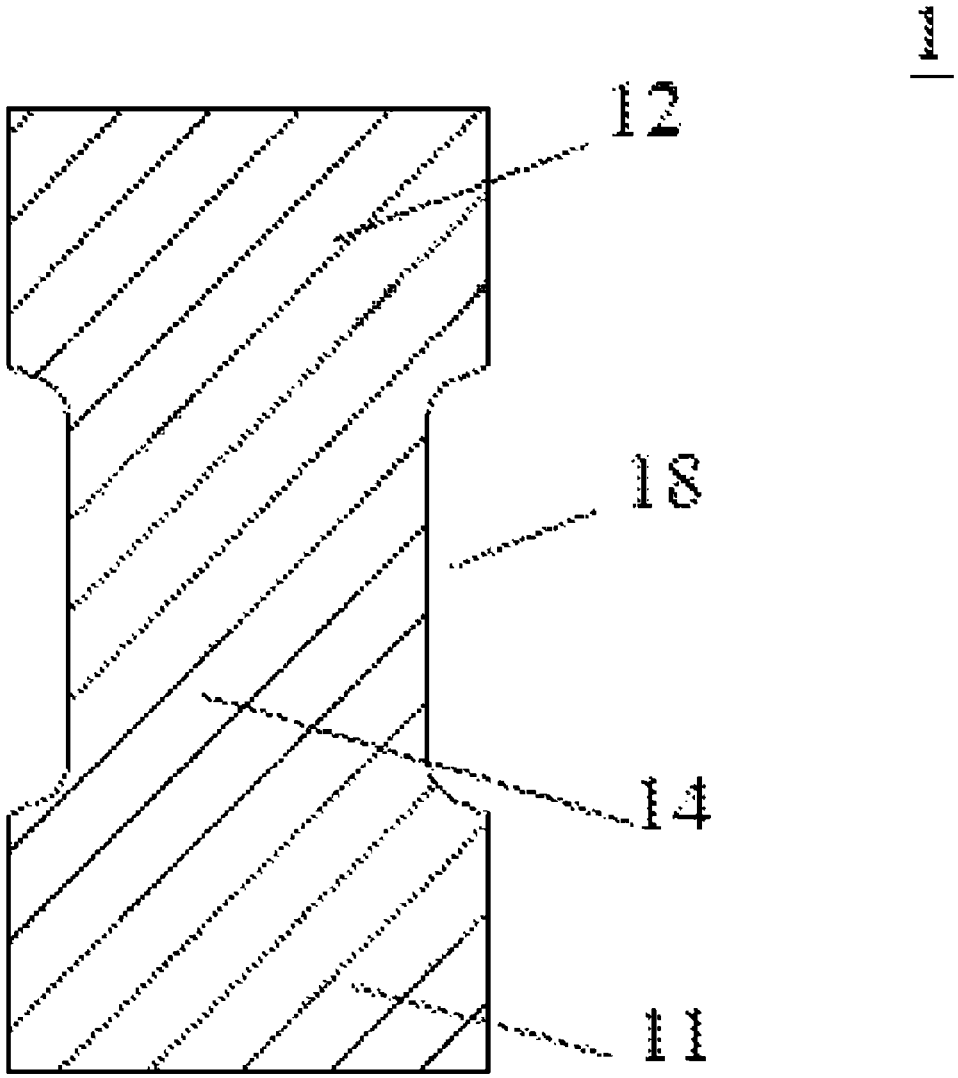
FIG. 3 is a sectional view of the wall block along A-A line of FIG. 2.

The cross section of the recess 28 may have various shapes, such as a rectangle, a semi-circle, or an irregular figure. Preferably, the cross section of the recess 28 is in a shape of ladder, as shown in FIG. 3. Meanwhile, in order to prevent the recess 28 from reducing the strength of the wall block, the depth of the recess 28 should be limited within a suitable range. Preferably, the depth of the recess 28 is 1/10-1/5 of the height of the rib 14.

In order to further increase the strength of the wall block, simplify the manufacture process, and enhance the applicability of the wall block, the wall block is generally formed to have a symmetrical structure. In particular, the wall block has a symmetrical structure in both width direction and height direction; and the surface of the third wall 13 towards the hollow portion 17 and the surface of the rib 14 towards the hollow portion 17 are both perpendicular to the length direction of the first wall 11. It should be noted that, the "perpendicular" used herein means that the trending direction of the rib 14 and the length direction of the first wall 11 have a perpendicular relation there-between.

Figure 2:
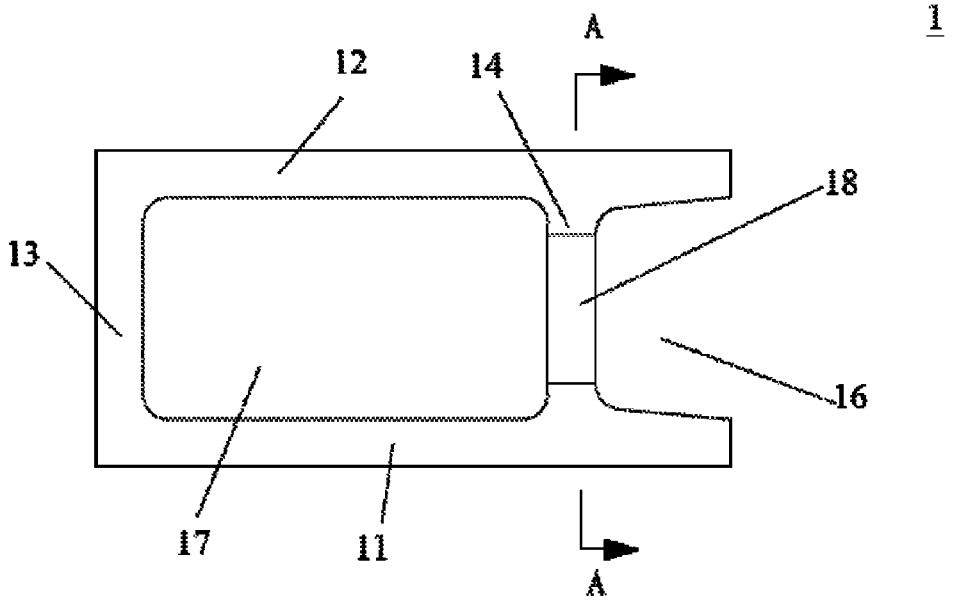
FIG. 2 is a front view of the wall block according to a first embodiment of the present invention.

As shown in FIG. 2, preferably, the hollow portion 17 and the opening portion 16 have rectangular shapes, and the length of the opening portion 16 is 1/3-2/3 of the length of the hollow portion 17. During piling up wall blocks, such structure may provide enough space for arranging a bearing pillar, enhance the strength of the wall body effectively, and increase the durability of the wall body. This will be described later in details for the wall body.

More preferably, the length of the opening portion 16 is 1/2 of the length of the hollow portion 17. With such design, the shape and the size of an empty portion formed by the opening portion 16 of two adjacent wall blocks during piling up the wall blocks are the same as that of the hollow portion 17; when filling with cement mortar, the cement mortar may flow into the empty portion and the hollow portion 17 uniformly, to enhance the strength of the wall body. Meanwhile, such structure makes the load-bearing structure arranged in the wall body distributed uniformly, which can enhance the strength of the wall body more effectively.

In the present embodiment, the shapes of the hollow portion 17 and of the opening portion 16 are not limited to rectangles, for example, they may be in shapes of circles, semi-circles, or other irregular figures. The shapes of the hollow portion 17 and of the opening portion 16 may be selected depending on the particular application. In addition, the shapes of the hollow portion 17 and of the opening portion 16 may be not the same.

The wall block may be made of materials known to the skilled person in the art, such as cement, gypsum and the like. However, it may also be made of other materials. The wall block provided in this embodiment is formed by solidification of a material combination. The material combination may contain silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

The inventor has made a detailed research on the wall block which uses silicon sand as the host material, and found that when adding the re-dispersible emulsion powder and the fiber, the strength of the obtained wall block may reach or exceed the strength of the concrete block so that the wall block may meet the construction demands. Furthermore, when the weight ratio of the fiber to the re-dispersible emulsion powder is 0.5-1.5:1, the obtained wall block has higher strength; more preferably, the weight ratio of the fiber to the re-dispersible emulsion powder is 0.8-1.2:1, in order to provide a material combination suitable for preparing a wall block in a region rich in sand resource.

In this embodiment, there are no special limitations on the kinds of the fiber. For example, it may be one or more selected from synthetic fiber, inorganic fiber (e.g. glass fiber), mineral fiber and plant fiber. The size of the fiber may be varied within a wider range, but the inventor has found that, when a fiber with a length of 1-30 mm and a diameter of 0.1-100 μm is used, the obtained wall block has higher strength; it's more preferably to use a fiber with a length of 5-15 mm and a diameter of 5-50 μm.

According to this embodiment, there are no special limitations on the kinds of "re-dispersible emulsion powder"; for example, it may be one or more selected from the copolymerized emulsion powder of vinylacetate and ethylene, the terpolymerized emulsion powder of ethylene, vinyl chloride and vinyl laurate, the copolymerized emulsion powder of acrylic ester and styrene, and the copolymerized emulsion powder of styrene and butadiene. More preferably, the weight-average molecular weight of the re-dispersible emulsion powder is 500-20000, and the average particle diameter is 1-300 μm. The re-dispersible emulsion powder that meets the demands mentioned above may be bought commercially, such as the LR-80 and LR-100 type re-dispersible emulsion powder manufactured by Shijiazhuang Longrui Building Materials Co. Ltd.

In this embodiment, there are no special limitations on the resource of the silicon sand, it may be one or more selected from sea sand, tidal sand, river sand, aeolian sand, manufactured sand and reclaimed sand; more preferably is aeolian sand; In this embodiment, there are no special limitations on the average diameter of the silicon sand, and the silicon sand with the average particle diameter of 10-500 μm, more preferably of 50-200 μm, may be used.

According to this embodiment, the kinds of the reducing water agent are well known to the skilled person in the art. For example, it may be one or more selected from lignosulfonate, polycyclic aromatic salt and water soluble, resin sulfonate. The reducing water agent may be bought commercially, for example, it may be bought from Beijing Muhu Additive Co. Ltd.

When used, the material combination provided in this embodiment is mixed with water uniformly, and then introduced into a molding for solidification, so that a wall block is obtained.

Figure 4:
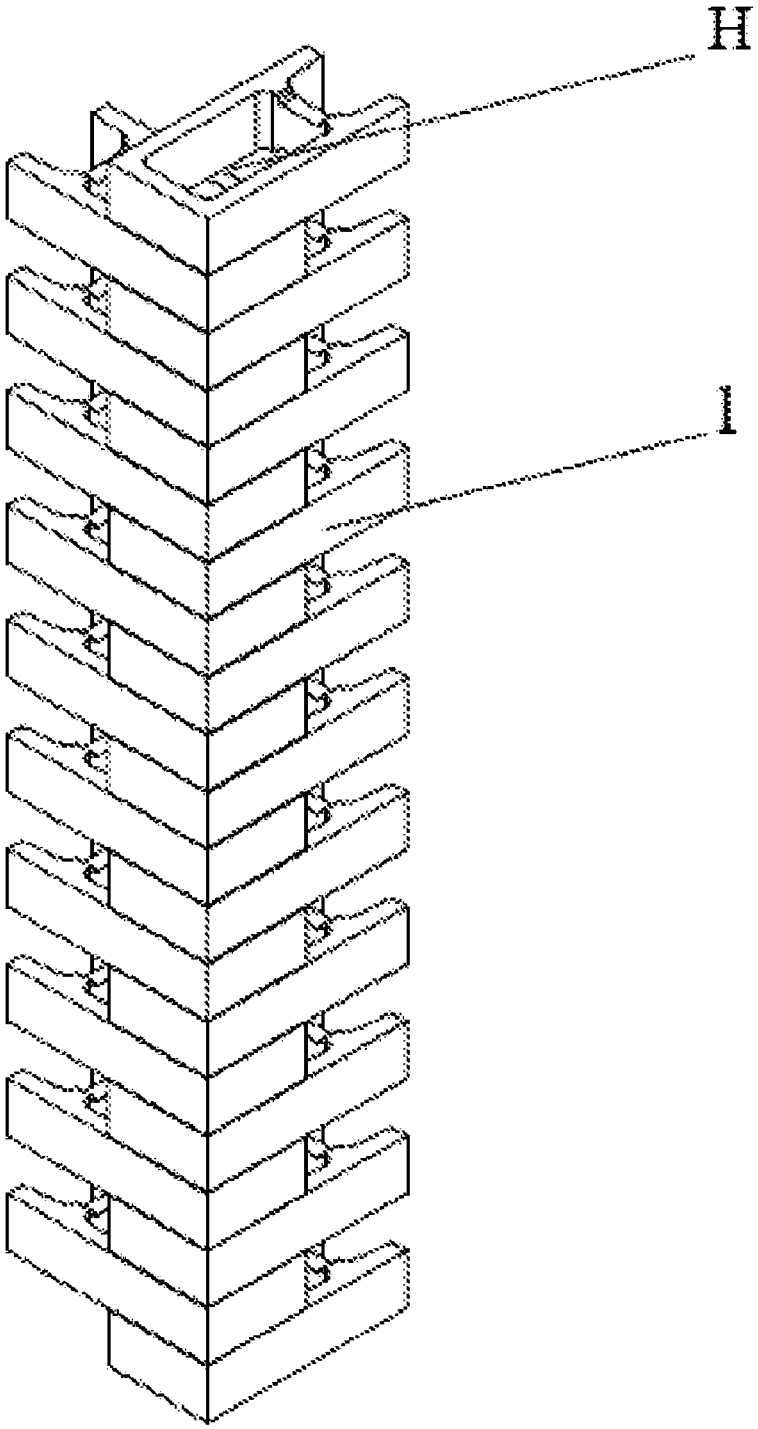
FIG. 4 is a perspective structural schematic diagram of the wall corner according to a preferred embodiment of the present invention.

As shown in FIG. 4, this embodiment also provides a wall corner. The wall corner comprises a plurality of said wall blocks 1 piled up on top of each other in the height direction; any two wall blocks 1 adjacent to each other in height direction are mutually perpendicular in length direction, to form a vertical through hole H inside the wall corner. The thermal insulation material may be filled into the vertical through hole H for enhancing the thermal insulation performance of the wall body; moreover, the cement mortar may be poured into or the bearing pillar may be inserted into the vertical through hole H for increasing the strength of the wall body.

The wall corner provided in this embodiment of course is not limited to the particular forms shown in FIG. 4. The wall block provided in this embodiment may be formed as a T-shape wall corner or a cross-shaped wall corner. Meanwhile, the wall blocks 1 adjacent to each other in height direction may not be mutually perpendicular in length direction; for example, they may form an obtuse angle or an acute angle. The form of the wall corner to be formed should be determined depending on the particular demands.

In addition, the usage of the wall block provided in this embodiment is not limited to a wall corner. Besides piling up to form a wall corner, the wall blocks are also used to construct a wall body.

Second Embodiment

Figure 5:
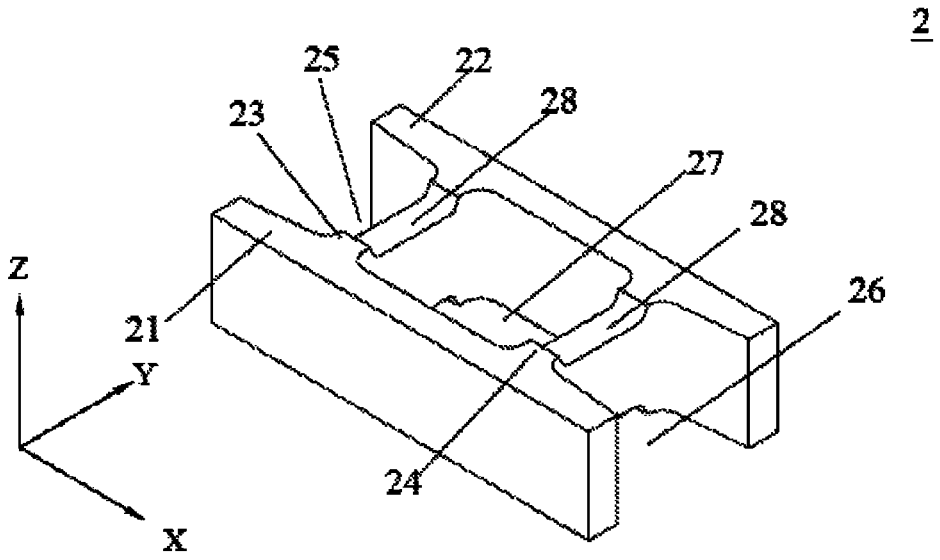
FIG. 5 is a perspective structural schematic diagram of the wall block according to a second embodiment of the present invention.

In this embodiment, the length direction is the X direction in FIG. 5, the width direction is the Y direction in FIG. 5, and the height direction is the Z direction in FIG. 5. The upper surfaces are the surfaces of the first wall 21 and of the second wall 22 facing upwards, and the lower surfaces are the surfaces of the first wall 21 and of the second wall 22 facing downwards, as shown in FIG. 5.

As shown in FIG. 5, this embodiment provides a wall block comprising a first wall 21 and a second wall 22 parallel with each other, as well as a first rib 23 and a second rib 24 which are securely connected between the first wall 21 and the second wall 22. The first rib 23 and the second rib 24 form a hollow portion 27 therebetween. The wall block further comprises a first opening portion 25 and a second opening portion 26 which are arranged between the first wall 21 and the second wall 22; moreover, the first rib 23 is arranged between the first opening portion 25 and the hollow portion 27, and the second rib 24 is arranged between the second opening portion 26 and the hollow portion 27.

With the technical solution mentioned above, as the wall block has a hollow structure, the load-bearing structure (such as a bearing pillar) may be arranged directly within the hollow structure of the wall block, unlike the traditional solid wall blocks which need to be piled up around the load-bearing structure (such as a bearing pillar) at a large amount. Therefore, the wall block provided in the present invention may save the time for piling up the same and enhance the construction efficiency.

The first wall 21 and the second wall 22 are in parallel with each other so that a wall body can be easily formed as a plane by piling up wall blocks, which facilitates the proceeding of subsequent process such as finishing. The first rib 23 and the second rib 24 are securely connected between the first wall 21 and the second wall 22 to form a hollow structure. Meanwhile, securely connecting may also enhance the strength of the wall block so that the wall block has higher durability. The first wall 21, the second wall 22, the first rib 23 and the second rib 24 are securely connected together by various ways, such as by bonding with a binding agent or the same. Apparently, for convenient manufacture and reduced cost, the first wall 21, the second wall 22, the first rib 23 and the second rib 24 are preferably formed integrally by means of, for example, pouring.

As shown in FIG. 5, preferably the first rib 23, the second rib 24, the first wall 21 and the second wall 22 have the same height. The upper surfaces of the first rib 23 and of the second rib 24 are flush with the upper surfaces of the first wall 21 and of the second wall 22. Such wall block facilitates manufacture and transportation as well as piling up the same. The wall body constructed by piling up the wall blocks, of which the upper surface is flush with the lower surface, has higher strength.

As shown in FIG. 5, preferably a recess 28 is arranged on the upper surface and/or the lower surface of the first rib 23, and a recess 28 is arranged on the upper surface and/or the lower surface of the second rib 24. Such structure is arranged not only to save the material, but also to reduce the weight of the wall block. Furthermore, a bearing pillar may be arranged at the recess 28 in the length direction (i.e. the X direction) of the wall block, if necessary, so that the strength of the wall body constructed by piling up the wall blocks is enhanced.

Figure 7:
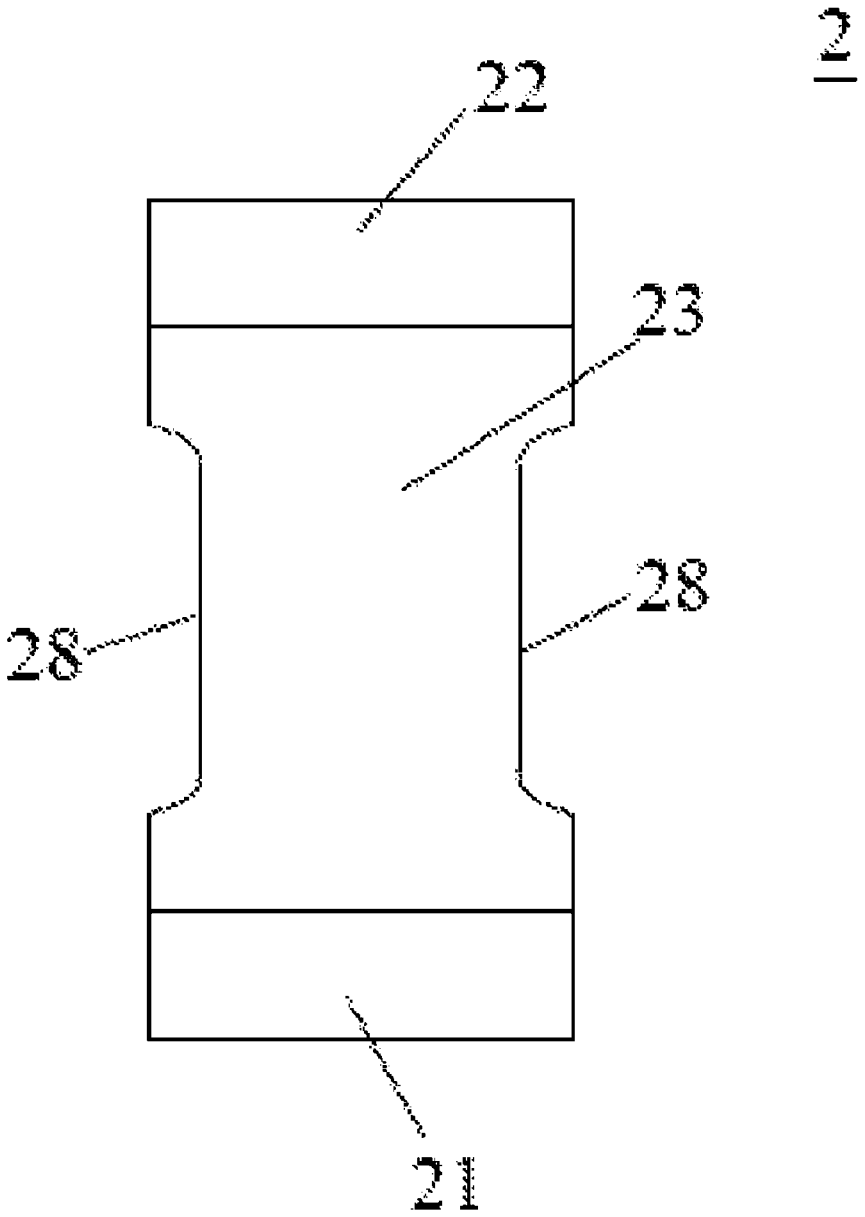
FIG. 7 is a side view of the wall block according to a second embodiment of the present invention.

The cross section of the recess 28 may have various shapes, such as a rectangle, a semi-circle, or an irregular figure. Preferably, the cross section of the recess 28 is in a shape of ladder, as shown in FIG. 7. Meanwhile, in order to prevent the recess 28 from reducing the strength of the wall block, the depth of the recess 28 should be limited within a suitable range. Preferably, the depth of the recess 28 is 1/10-1/5 of the height of the first rib 23.

In order to further increase the strength of the wall block, simplify the manufacture process, and enhance the applicability of the wall block, the wall block preferably has a centrosymmetric structure; moreover, the surface of the first rib 23 towards the hollow portion 27 and the surface of the second rib 24 towards the hollow portion 27 are both perpendicular to the length direction of the first wall 21. It should be noted that, the "perpendicular" used herein means the trending directions of the first rib 23 and of the second rib 24 have a perpendicular relation with the length direction of the first wall 21.

Figure 6:
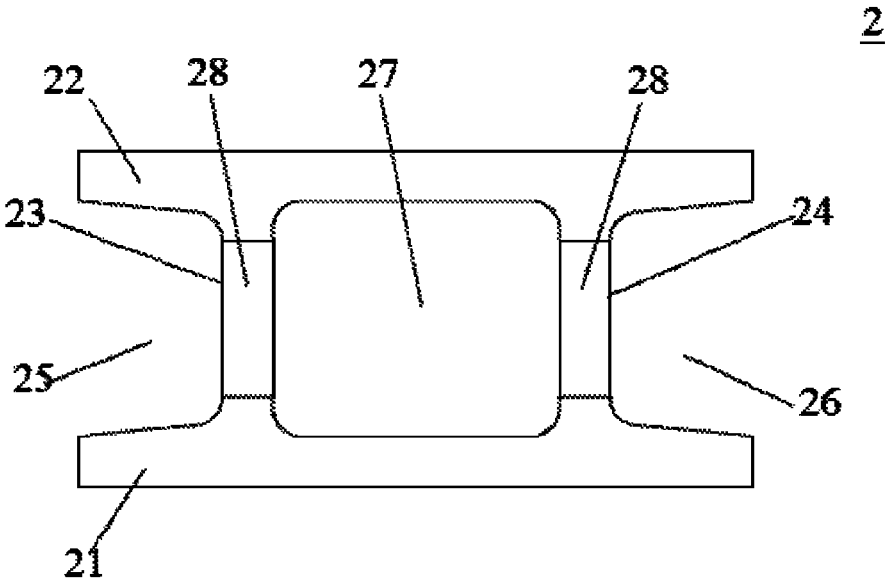
FIG. 6 is a front view of the wall block according to a second embodiment of the present invention.

As shown in FIG. 6, the hollow portion 27, the first opening portion 25 and the second opening portion 26 have rectangular shapes, and the length of each of the first opening portion 25 and the second opening portion 26 is 1/3-2/3 of the length of the hollow portion 27. During piling up wall blocks, such structure may provide enough space for arranging a bearing pillar, enhance the strength of the wall body effectively, and increase the durability of the wall body. More preferably, the length of each of the first opening portion 25 and the second opening portion 26 is 1/2 of the length of the hollow portion 27. With such design, the shape and the size of an empty portion formed by the two wall blocks adjacent to each other during piling up the wall blocks are the same with that of the hollow portion 27; when filling with cement mortar, the cement mortar may flow into the empty portion and the hollow portion 27 uniformly, to enhance the strength of the wall body. Meanwhile, such design makes the load-bearing structure arranged in the wall body distributed uniformly, which can enhance the strength of the wall body more effectively.

In this embodiment, the shapes of the hollow portion 27 and of the opening portion are not limited to rectangles, for example, they may be circles, semi-circles, or other irregular figures. The shapes of the hollow portion 27 and the opening portion may be selected depending on the particular application. In addition, the shapes of the hollow portion 27 and the opening portion may be not the same.

The wall block may be made of materials known to the skilled person in the art, such as cement, gypsum and the like. However, it may also be made of other materials. The wall block provided in this embodiment is formed by solidification of a material combination. The material combination may contain silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, the water content is 15-50 parts by weight.

The inventor has made a detailed research on the wall block which uses silicon sand as the host material, and found that when adding the re-dispersible emulsion powder and the fiber, the strength of the obtained wall block may reach or exceed the strength of the concrete block so that the wall block may meet the construction demands. When the weight ratio of the fiber to the re-dispersible emulsion powder is 0.5-1.5:1, the obtained wall block has higher strength; more preferably, the weight ratio of the fiber to the re-dispersible emulsion powder is 0.8-1.2:1, in order to provide a material combination suitable for preparing a wall block in a region rich in sand resource.

In this embodiment, there are no special limitations on the kinds of the fiber, for example, it may be one or more selected from synthetic fiber, inorganic fiber (glass fiber), mineral fiber and plant fiber. The size of the fiber may be varied within a wider range, but the inventor has found that, when a fiber with a length of 1-30 mm and a diameter of 0.1-100 μm is used, the obtained wall block has higher strength; it's more preferably to use a the fiber with a length of 5-15 mm and a diameter of 5-50 μm.

According to this embodiment, there are no special limitations on the kinds of "re-dispersible emulsion powder"; for example, it may be one or more selected from the copolymerized emulsion powder of vinylacetate and ethylene, the terpolymerized emulsion powder of ethylene, vinyl chloride and vinyl laurate, the copolymerized emulsion powder of acrylic ester and styrene, and the copolymerized emulsion powder of styrene and butadiene. More preferably, the weight-average molecular weight of the re-dispersible emulsion powder is 500-20000, and the average particle diameter is 1-300 μm. The re-dispersible emulsion powder that meets the demands mentioned above may be bought commercially, such as the LR-80 and LR-100 type re-dispersible emulsion powder manufactured by Shijiazhuang Longrui Building Materials Co. Ltd.

In this embodiment, there are no special limitations on the resource of the silicon sand, it may be one or more selected from sea sand, tidal sand, river sand, aeolian sand, manufactured sand and reclaimed sand; more preferably is aeolian sand; In this embodiment, there are no special limitations on the average diameter of the silicon sand, and the silicon sand with the average particle diameter of 10-500 μm may be used, more preferably the aeolian sand with the average particle diameter of 50-200 μm may be used.

According to this embodiment, the kinds of the reducing water agent are well known to the skilled person in the art. For example, it may be one or more selected from lignosulfonate, polycyclic aromatic salt, and water soluble resin sulfonate. The reducing water agent may be bought commercially, for example, it may be bought from Beijing Muhuwai Addition Co. Ltd.

When used, the material combination provided in this embodiment is mixed with water uniformly, and then introduced into a molding for curing, so that a wall block is obtained.

Figure 8:
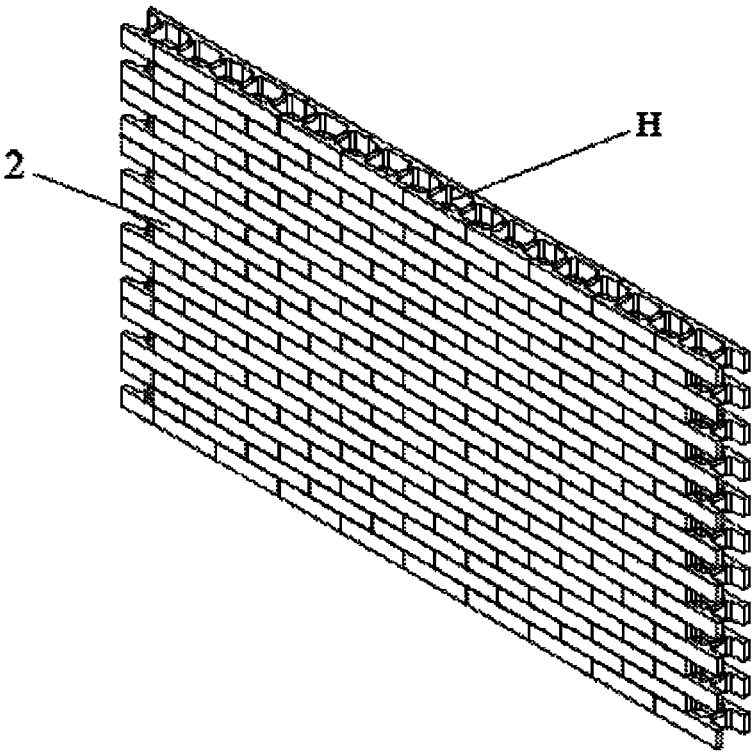
FIG. 8 is a perspective structural schematic diagram of the wall body according to a preferred embodiment of the present invention.

As shown in FIG. 8, this embodiment also provides a wall body. The wall body comprises a plurality of the wall blocks 2 piled up one by one in both length direction and height direction to form a vertical through hole H inside the wall body. Furthermore, when the recess 28 is arranged respectively on the first rib 23 and the second rib 24, a transverse through hole is also formed inside the wall body by piling up the wall blocks one by one. The thermal insulation material may be filled into the vertical through hole H and the transverse hole to improve the thermal insulation performance of the wall body; moreover, the cement plaster may be poured into or a load-bearing structure may be inserted into the vertical through hole H and the transverse hole, to enhance the strength of the wall body.

The method of forming the vertical through hole will be described in details as follows. For facilitating the description, the first opening portion and the second opening portion are both referred to as the opening portion. A plurality of the wall blocks are piled up one by one in the length direction so that the opening portions of two adjacent wall blocks are facing to each other so as to form a combination hole. At the same time, a plurality of the wall blocks are piled up on top of each other in the height direction so that the hollow portion of the wall block can be communicated, in the height direction, with the hollow portion of the other wall block or with the combination hole, to form a vertical through hole inside the wall body.

The wall body provided in this embodiment of course is not limited to the forms shown in FIG. 8, and its particular structure should be determined according to the particular demands. Meanwhile, the wall block provided in this embodiment may be used with a common wall block, and the vertical through hole mentioned above may be formed at a position to be strengthened so as to enhance the strength of the wall body to a certain degree.

Third Embodiment

Figure 9:
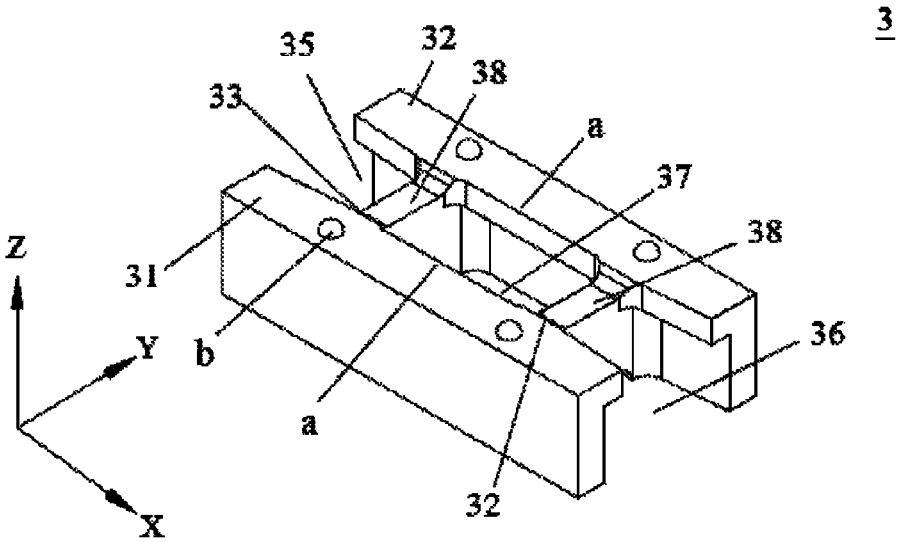
FIG. 9 is a perspective view of the wall block according to a third embodiment of the present invention.

In this embodiment, the length direction is the X direction in FIG. 9, the width direction is the Y direction in FIG. 9, and the height direction is the Z direction in FIG. 9. The length means the size in the length direction; the width means the size in the width direction; the height means the size in the height direction. The upper surfaces are the surfaces of the first wall 31 and of the second wall 32 facing upwards, the lower surfaces are the surfaces of the first wall 31 and of the second wall 32 facing downwards, and the end surfaces are the surfaces of the ends of the wall block shown in FIG. 9.

As shown in FIG. 9, this embodiment provides a wall block comprising a first wall 31 and a second wall 32 parallel with each other, as well as a first rib 33 and a second rib 34 which are securely connected between the first wall 31 and the second wall 32. The first rib 33 and the second rib 34 form a hollow portion 37 therebetween. The wall block further comprises a first flange arranged on one side of the first wall 31 towards the hollow portion 37 and/or one side of the second wall 32 towards the hollow portion 37.

With the technical solution mentioned above, the wall block comprises a first flange a, which may support the filling material over the first flange and provide a supporting force for the same. The wall block prevents the filling material from deposing by the combined function of the friction force (or the adhesive force) among the first wall 31, the second wall 32, the first rib 33, the second rib 34 and the filling material, the supporting force acting on the filling material by the first flange a, and the bonding force within the filling material, so that the fault phenomenon of the filling material and the breaking phenomenon of the wall block are avoided.

The first wall 31 and the second wall 32 are in parallel with each other so that a wall body can be easily formed as a plane by piling up wall blocks, which facilitates the proceeding of subsequent process such as finishing. The first rib 33 and the second rib 34 are securely connected between the first wall 31 and the second wall 32 to form a hollow structure 37 for accommodating the filling material. Meanwhile, securely connecting may also enhance the strength of the wall block so that the wall block has higher durability. The first wall 31, the second wall 32, the first rib 33 and the second rib 34 are securely connected together by various ways, such as by bonding with a binding agent. Apparently, for convenient manufacture and reduced cost, the first wall 31, the second wall 32, the first rib 33 and the second rib 34 are preferably formed integrally, by means of, for example, pouring.

The first flange a may have various shapes, such as a plate form. For enhancing the bonding strength between the wall block and the filling material, the surface of the first flange a may be formed as a rough surface or have an accidented structure. In addition, a plurality of first flanges a may be formed on the same wall (i.e. the first wall 31 or the second wall 32). At the same time, the extending direction of the first flange a may or may not be identical to the extending direction of the first wall 31 and the second wall 32. The first flange a may be arranged on the side surface(s) of the first wall 31 and/or the second wall 32 by various ways, such as by bonding with a binding agent. For enhancing the bonding strength between the first flange a and the first wall 31 and/or the second wall 32, the first flange a and the first wall 31 and/or the second wall 32 may preferably be formed integrally.

Figure 13:
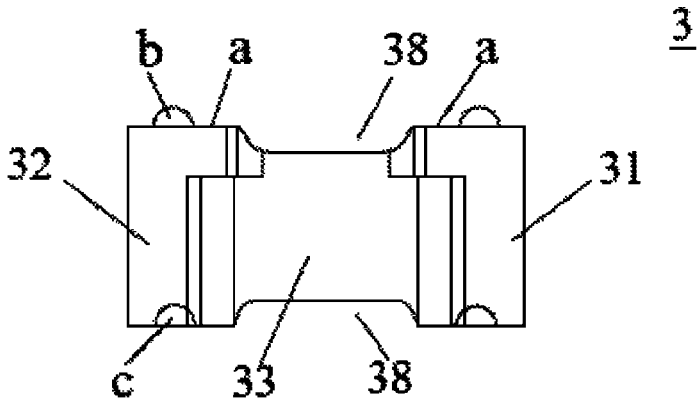
FIG. 13 is a left view of the wall block according to a third embodiment of the present invention.

The first flange a may be arranged at any position on the side surface(s) of the first wall 31 and/or the second wall 32, such as a position near the upper surface or the lower surface of the first wall 31 and/or the second wall 32, and a position far away from the upper surface or the lower surface of the first wall 31 and/or the second wall 32. Preferably, as shown in FIG. 9 and FIG. 13, the upper surface of the first flange a and the upper surface(s) of the first wall 31 and/or the second wall 32 are flush with each other. In this way, such wall block facilitates manufacture and transportation as well as piling up the same.

Figure 12:
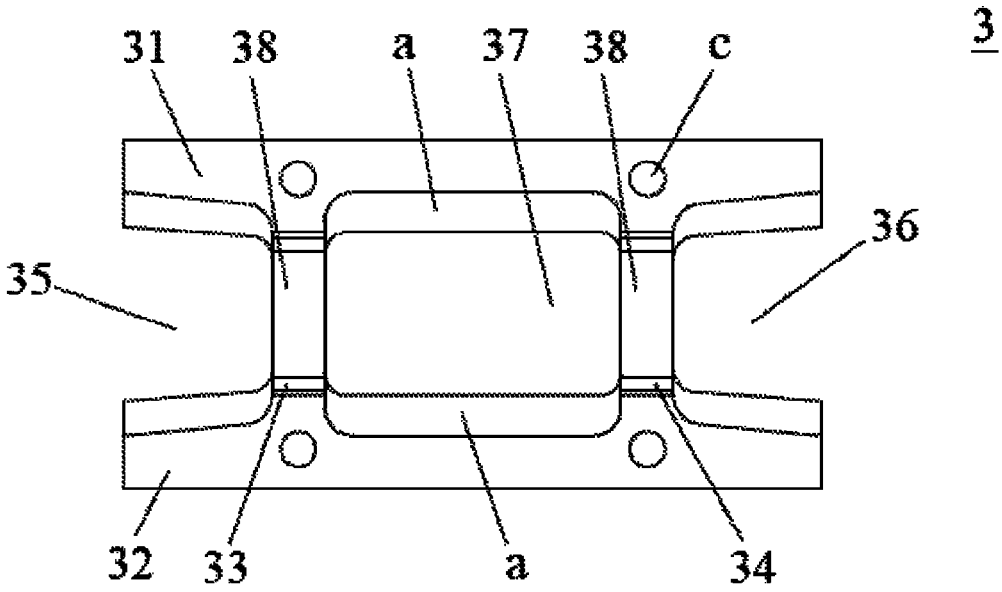
FIG. 12 is a bottom view of the wall block according to a third embodiment of the present invention.

Preferably, as shown in FIG. 9 and FIG. 12, the first flange a extends over the entire length of the first wall 31 and/or the second wall 32 in the length direction of the wall block. As the first wall 31 and/or the second wall 32 have (has) the first flange(s) a provided in the entire length direction, the wall block can disperse the weight of the filling material throughout the wall body sufficiently, to prevent the filling material from faulting. However, this embodiment is not limited to this structure, the first flange a, for example, may extend over part of the length of the first wall 31 and/or the second wall 32.

For enhancing the effect of the first flange a, the contact area between the first flange a and the filling material may be increased appropriately, i.e. increasing the size of the first flange a. The width of the first flange a is preferably 1/10-1/4 of the width of the hollow portion 37. In this way, it may enable the first flange a and the filling material to have enough contact area therebetween and ensure the filling material to enter the hollow portion 37 of the other wall block through the hollow portion 37 smoothly, thus to prevent the filling material inside the wall body from faulting.

As described above, the first flange a may be arranged on either the first wall 31 or the second wall 32, or, arranged on both the first wall 31 and the second wall 32. Preferably, the first flange a is arranged on the first wall 31 and the second wall 32; and the first flange a on the first wall 31 has the same shape, structure and size with that of the first flange a on the second wall 32. With such structure, the first flange a may disperse the weight of the filling material onto the first wall 31 and the second wall 32 of the wall block uniformly, so as to prevent the wall body from breaking caused by uneven force.

As shown in FIG. 9, preferably, the wall block comprises a first opening portion 35 arranged between the first wall 31 and the second wall 32; and the first rib 33 is arranged between the first opening portion 35 and the hollow portion 37. Preferably, the wall block further comprises the second opening portion 36 arranged between the first wall 31 and the second wall 32, and the second rib 34 is arranged between the second opening portion 36 and the hollow portion 37. In this way, when constructing a wall body by piling up wall blocks, the wall blocks adjacent to each other in the length direction form an empty portion by abutting connection of the first opening portion 35 and/or the second opening portion 36; the thermal insulation material or the concrete material and the like may be filled within the empty portion so as to prevent the gaps generated at the connection between the wall blocks from influencing the thermal insulation performance or the strength of the wall body.

Figure 11:
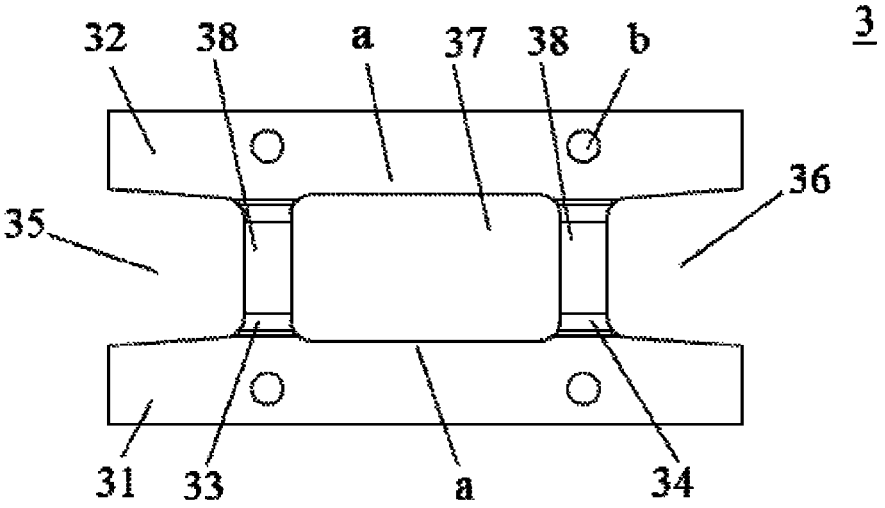
FIG. 11 is a top view of the wall block according to a third embodiment of the present invention.

As shown in FIG. 11 and FIG. 12, the hollow portion 37, the first opening portion 35 and the second opening portion 36 have rectangular shapes, and the length of each of the first opening portion 35 and the second opening portion 36 is 1/3-2/3 of the length of the hollow portion 37. During piling up wall blocks, such structure may provide enough space for filling so that the filling material can enter into the empty portion and the hollow portion 37 so as to enhance the performance (such as the thermal insulation performance and the strength) of the wall body. Apparently, the shapes of the hollow portion 37, the first opening portion 35 and the second opening portion 36 are not limited to rectangles, for example, they may be of circles, semi-circles, or other irregular figures. The shapes of the hollow portion 37, the first opening portion 35 and the second opening portion 36 may be selected depending on the particular application. In addition, the shapes of the hollow portion 37, the first opening portion 35 and the second opening portion 36 may be not the same.

Preferably, the wall block further comprises a second flange (not shown) arranged on one side of the first rib 33 towards the hollow portion 37 and/or one side of the first rib 33 towards the first opening portion 35.

Preferably, the wall block further comprises a third flange (not shown) arranged on one side of the second rib 34 towards the hollow portion 37 and/or one side of the second rib 34 towards the second opening portion 36.

The second flange and the third flange can further disperse the weight of the filling material to enhance the bonding strength between the wall block and the filling material so as to prevent the thermal insulation material inside the wall body from sinking caused by its weight force. At the same time, the second flange and the third flange can also enhance the strength of the wall block to prevent the wall block from being broken under the pressure of the filling material and the wall body. The shapes, the structures, the sizes and the arrangement forms of the second flange and of the third flange are the same as that of the first flange a, therefore the detailed description thereof is omitted.

The second flange and the third flange may be designed and selected according to the particular application. For example, it may only arrange the second flange or the third flange; alternatively, it may arrange both the second flange and the third flange. Furthermore, the second flange and the third flange may or may not have the same shapes and sizes.

As shown in FIG. 9 and FIG. 13, preferably, the wall block further comprises a first protruding portion b and/or a first recess c which are/is arranged on at least one surface of the upper surface and the lower surface of the wall block. When constructing a wall body by piling up wall blocks, the wall blocks adjacent to each other in the height direction may be positioned accurately by an engagement between the first protruding portion b and the first recess portion c so as to prevent the wall body from being deflected. The connection strength between the wall blocks may be enhanced by such engagement between the first protruding portion and the first recess portion c so that the wall body may bear a higher load.

Preferably, the wall block further comprises a second protruding portion and/or a second recess (now shown) which are/is arranged on at least one end surface of two end surfaces of the wall block in the length direction thereof. When constructing a wall body by piling up wall blocks, the wall blocks adjacent to each other in the length direction may be positioned accurately by the engagement between the second protruding portion and the second recess portion so as to prevent the wall body from being deflected. The connection strength between the wall blocks may be enhanced by such engagement between the second protruding portion and the second recess portion so that the wall body may bear a higher load.

Figure 10:
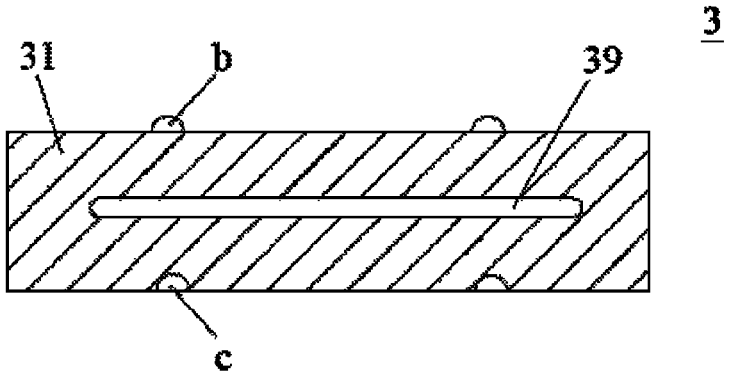
FIG. 10 is a cutaway view of the wall block according to a third embodiment of the present invention.
Figure 14:
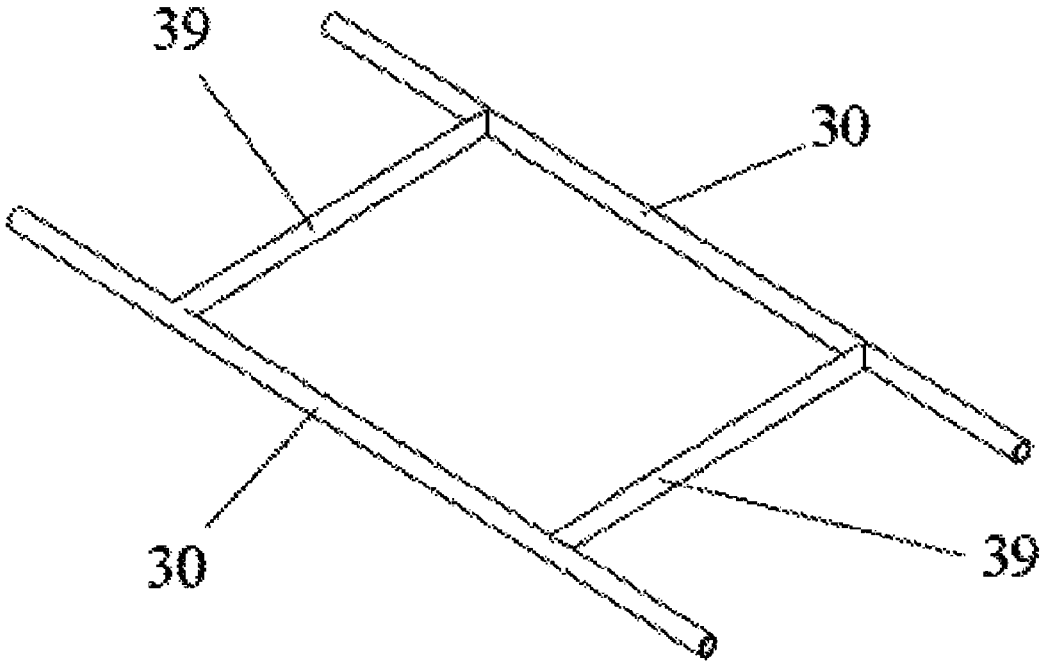
FIG. 14 is an integrally structural view of a strengthening rib framework composed of the longitudinal strengthening rib and the transverse strengthening rib of the wall block according to a third embodiment of the present invention.

In order to enhance the strength of the wall block, as shown in FIG. 10 and FIG. 14, a longitudinal strengthening rib 30 extending in the length direction of the wall block is provided within the first wall 31 and/or the second wall 32, a transverse strengthening rib 39 extending in the width direction of the wall block is provided within the first rib 33 and/or the second rib 34, and the transverse strengthening rib 39 and the longitudinal strengthening rib 30 are connected fixedly or formed integrally. The transverse strengthening rib 39 and the longitudinal strengthening rib 30 may be made from various materials, as long as it can enhance the strength of the wall block, such as steel. The longitudinal strengthening rib 30 and the transverse strengthening rib 39 may be connected fixedly by various methods, such as welding, screw connecting and the like. Besides the longitudinal strengthening rib 30 and the transverse strengthening rib 39, a vertical strengthening rib (not shown) extending in the height direction may be arranged within the wall block, and arranged to be connected fixedly or formed integrally with the longitudinal strengthening rib 30 and the transverse strengthening rib 39 so as to enhance the strength of the wall block.

As shown in FIG. 9, preferably, the first rib 33, the second rib 34, the first wall 31 and the second wall 32 have the same height. The upper surfaces of the first rib 33 and of the second rib 34 are flush with the upper surfaces of the first wall 31 and of the second wall 32. Such wall block facilitates manufacture and transportation as well as piling up the same. The wall body constructed by piling up the wall blocks, of which the upper surface is flush with the lower surface, has higher strength.

As shown in FIG. 9, preferably, a recess 28 is arranged on the upper surface and/or the lower surface of the first rib 33, and a recess 38 is arranged on the upper surface and/or the lower surface of the second rib 34. Such structure is arranged not only to save the material, but also to reduce the weight of the wall block. Furthermore, a bearing pillar may be arranged at the recess 38 in the length direction (i.e. the X direction) of the wall block, if necessary, so that the strength of the wall body constructed by piling up the wall blocks is enhanced.

The cross section of the recess 38 may have various shapes, such as a rectangle, a semi-circle, or an irregular figure. Preferably, the cross section of the recess 28 is in a shape of ladder, as shown in FIG. 13. Meanwhile, in order to prevent the recess 38 from reducing the strength of the wall block, the depth of the recess 38 should be limited within a suitable range. Preferably, the depth of the recess 38 is 1/10-1/5 of the height of the first rib 33.

In order to further increase the strength of the wall block, simplify the manufacture process, and enhance the applicability of the wall block, the wall block preferably has a centrosymmetric structure, and the surface of the first rib 33 towards the hollow portion 37 and the surface of the second rib 34 towards the hollow portion 37 are both perpendicular to the length direction of the first wall 31. It should be noted that, the "perpendicular" used herein means the trending direction of the first rib 33 and the second rib 34 has a perpendicular relation with the length direction of the first wall 31.

The wall block may be made of materials known to the skilled person in the art, such as cement, gypsum and the like. It may also be made of other materials. The wall block provided in this embodiment is formed by curing a material combination. The material combination may contain silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

The inventor has made a detailed research on the wall block which uses the silicon sand as the host material, and found that when adding the re-dispersible emulsion powder and the fiber, the strength of the obtained wall block may reach or exceed the strength of the concrete block so that the wall block may meet the construction demands. When the weight ratio of the fiber to the re-dispersible emulsion powder is 0.5-1.5:1, the obtained wall block has higher strength; more preferably, the weight ratio of the fiber to the re-dispersible emulsion powder is 0.8-1.2:1, in order to provide a material combination suitable for preparing a wall block in a region rich in sand resource.

In this embodiment, there are no special limitations on the kinds of the fiber, for example, it may be one or more selected from synthetic fiber, inorganic fiber (glass fiber), mineral fiber and plant fiber. The size of the fiber may be varied within a wider range, but the inventor has found that, when a fiber with a length of 1-30 mm and a diameter of 0.1-100 μm is used, the obtained wall block has higher strength; more preferably, the fiber has a length of 5-15 mm and a diameter of 5-50 μm.

According to this embodiment, there are no special limitations on the kinds of "re-dispersible" emulsion powder. The re-dispersible emulsion powder may be one or more selected from the copolymerized emulsion powder of vinylacetate and ethylene, the terpolymerized emulsion powder of ethylene, vinyl chloride and vinyl laurate, the copolymerized emulsion powder of acrylic ester and styrene, and the copolymerized emulsion powder of styrene and butadiene. The weight-average molecular weight of the re-dispersible emulsion powder is 500-20000, and the average particle diameter is 1-300 μm. The reducing water agent may be one or more selected from lignosulfonate, polycyclic aromatic salt and water soluble resin sulfonate. The re-dispersible emulsion powder that meets the demands mentioned above may be bought commercially, such as the LR-80 and LR-100 type re-dispersible emulsion powder manufactured by Shijiazhuang Longrui Building Materials Co. Ltd. The reducing water agent mentioned above may be bought commercially, such as the reducing water agent manufactured by Beijing Muhu Additive Co. Ltd.

In this embodiment, there are no special limitations on the resource of silicon sand, it may be one or more selected from sea sand, tidal sand, river sand, aeolian sand, manufactured sand and reclaimed sand, more preferably is aeolian sand; In this embodiment, there are no special limitations on the average particle diameter of the silicon sand, the silicon sand with the average particle diameter of 10-500 μm, more preferably of diameter of 50-200 μm, may be used.

As above, the preferred embodiments of the present invention have been described in details in combination with the accompanying drawings, but the present invention is not limited to the particular details in the embodiments mentioned above. Various simple modifications may be made to the technical solutions within the technical conception of the present invention, which belong to the protection scope of the present invention. It should be noted that the respective technical features described in the particular embodiments may be combined in any suitable ways if possible. For simplifying the description, no further details would be given for various possible combinations. In addition, any combination which may be made among the different embodiments of the present invention without departing from the concept of the present invention, should also be considered as the disclosure contained in the present invention.

What is claimed is:

1. A wall block, comprising:

a first longitudinally extending wall, the first longitudinally extending wall comprised of a first vertical wall portion defining a length of a wall block and a first horizontal wall portion inwardly depending from an upper side of the first vertical wall portion substantially defining a first upper surface along a first side of the wall block, the first vertical wall portion and first horizontal wall portion each having a similar wall thickness and length;

a second longitudinally extending wall parallel to the first wall, the second longitudinally extending wall comprised of a second vertical wall portion of the length of the wall block and second horizontal wall portion inwardly depending from an upper side of the second vertical wall portion substantially defining a second upper surface along a second side of the wall block, the second vertical wall portion and second horizontal wall portion each having a similar wall thickness and length to the wall thickness and length of the first longitudinally extending wall;

a first rib connected between the first longitudinally extending wall and the second longitudinally extending wall spaced a distance from first corresponding ends of the first and second longitudinally extending walls and forming a first opening between the first and second longitudinally extending walls and the first rib; and a second rib connected between the first longitudinally extending wall and the second longitudinally extending wall spaced a distance from second corresponding ends of the first and second longitudinally extending walls forming a second opening between the first and second longitudinally extending walls and the second rib and forming a hollow space defined by the first and second longitudinally extending walls and the first and second ribs.

2. The wall block of claim 1, wherein the first longitudinally extending wall and the second longitudinally extending wall have the same height, and at least a portion of the first and second upper surfaces of each of the first rib and the second rib are recessed relative to the first and second upper surfaces of the first longitudinally extending wall and of the second longitudinally extending wall.

3. The wall block of claim 1, wherein a bottom surface of the first rib defines a first recess extending between the first longitudinally extending wall and the second longitudinally extending wall.

4. The wall block of claim 3, wherein bottom surface of the second rib defines a second recess extending between the first horizontal wall portion and the second horizontal wall portion.

5. The wall block of claim 3, wherein the first and second ribs have the same height and the first and second recesses have a depth of 1/10 to 1/5 of the height of the first and second ribs.

6. The wall block of claim 1, wherein the wall block is symmetrical about a first vertical plane bisecting the first and second longitudinally extending walls of the wall block and a second vertical plane bisecting the first and second ribs of the wall block.

7. The wall block of claim 1, wherein the first and second ribs are perpendicular to the first and second walls.

8. The wall block of claim 7, wherein a shape of the hollow space is substantially rectangular and a shape of the first and second openings are substantially rectangular.

9. The wall block of claim 1, wherein lengths of the first and second openings are 1/3-2/3 of the length of the hollow space.

10. The wall block of claim 1, wherein the wall block is formed by solidification of a material combination, the material combination comprising silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

11. The wall block of claim 10, wherein the fiber is selected from at least one of synthetic fiber, inorganic fiber, mineral fiber and plant fiber where the fiber length is 1-30 mm, and the average diameter is 0.1-100 μm; where the re-dispersible emulsion powder comprises at least one of a copolymerized emulsion powder of vinylacetate and ethylene, a terpolymerized emulsion powder of ethylene, vinyl chloride and vinyl laurate, a copolymerized emulsion powder of acrylic ester and styrene, and a copolymerized emulsion powder of styrene and butadiene; where a weight-average molecular weight of the re-dispersible emulsion powder is 500-20000, and the average particle diameter is 1-300 μm; where an average particle diameter of the silicon sand is 10-500 μm; the reducing water agent is comprised of at least one of lignosulfonate, polycyclic aromatic salt and water soluble resin sulfonate.

12. The wall block of claim 1, further comprising a first plurality of protrusions extending from a first top surface of the first side wall and a second plurality of protrusions extending from a second top surface of the second side walls, the first and second plurality of protrusions positioned away from an edge of a the first and second top surfaces, and comprising a first plurality of recesses formed in a bottom surface of the first side wall and a second plurality of recesses formed in a bottom surface of the second side wall, the first plurality of recesses positioned to engage the first plurality of protrusions of another wall block and the second plurality of recesses positioned to engage with the second plurality of protrusions of the other wall block when a plurality of wall blocks are stacked upon one another.

13. A wall corner formed from a plurality of wall blocks, comprising:

a plurality of the wall blocks, each wall block comprising a first longitudinally extending wall, the first longitudinally extending wall comprised of a first vertical wall portion defining a length of a wall block and a first horizontal wall portion inwardly depending from an upper side of the first vertical wall portion substantially defining a first upper surface along a first side of the wall block, the first vertical wall portion and first horizontal wall portion each having a similar wall thickness and length;

a second longitudinally extending wall parallel to the first wall, the second longitudinally extending wall comprised of a second vertical wall portion of the length of the wall block and second horizontal wall portion inwardly depending from an upper side of the second vertical wall portion substantially defining a second upper surface along a second side of the wall block, the second vertical wall portion and second horizontal wall portion each having a similar wall thickness and length to the wall thickness and length of the first longitudinally extending wall;

a first rib connected between the first longitudinally extending wall and the second longitudinally extending wall spaced a distance from first corresponding ends of the first and second longitudinally extending walls and forming a first opening between the first and second longitudinally extending walls and the first rib; and a second rib connected between the first longitudinally extending wall and the second longitudinally extending wall spaced a distance from second corresponding ends of the first and second longitudinally extending walls forming a hollow space defined by the first and second longitudinally extending walls and the first and second ribs;

wherein each of the plurality of the wall blocks is stacked on top of one another in a height direction with each pair of adjacent wall blocks in the height direction being mutually parallel with each other in the length direction, and wherein the hollow space of each wall block is aligned to form a vertical through hole inside the wall corner.

14. A wall formed from a plurality of wall blocks, comprising:

a plurality of the wall blocks, each wall block comprising;

a first longitudinally extending wall, the first longitudinally extending wall comprised of a first vertical wall portion defining a length of a wall block and a first horizontal wall portion inwardly depending from an upper side of the first vertical wall portion substantially defining a first upper surface along a first side of the wall block, the first vertical wall portion and first horizontal wall portion each having a similar wall thickness and length;

a second longitudinally extending wall parallel to the first wall, the second longitudinally extending wall comprised of a second vertical wall portion of the length of the wall block and second horizontal wall portion inwardly depending from an upper side of the second vertical wall portion substantially defining a second upper surface along a second side of the wall block, the second vertical wall portion and second horizontal wall portion each having a similar wall thickness and length to the wall thickness and length of the first longitudinally extending wall;

a first rib connected between the first longitudinally extending wall and the second longitudinally extending wall spaced a distance from first corresponding ends of the first and second longitudinally extending walls and forming a first opening between the first and second longitudinally extending walls and the first rib; and a second rib connected between the first longitudinally extending wall and the second longitudinally extending wall spaced a distance from second corresponding ends of the first and second longitudinally extending walls forming a second opening between the first and second longitudinally extending walls and the second rib and forming a hollow space defined by the first and second longitudinally extending walls and the first and second ribs;

wherein each of the plurality of the wall blocks is stacked on top of one another in a height direction with each pair of adjacent wall blocks in the height direction being mutually parallel with each other in the length direction, and wherein the hollow space of each wall block is aligned with the first and second openings of adjacent wall blocks in a height direction to form a vertical through hole inside the wall.

15. A wall block, comprising:

a first longitudinally extending wall, the first longitudinally extending wall comprised of a first vertical wall portion defining a length of a wall block and a first horizontal wall portion inwardly depending from an upper side of the first vertical wall portion substantially defining a first upper surface along a first side of the wall block, the first vertical wall portion and first horizontal wall portion each having a similar wall thickness and length;

a second longitudinally extending wall parallel to the first wall, the second longitudinally extending wall comprised of a second vertical wall portion of the length of the wall block and second horizontal wall portion inwardly depending from an upper side of the second vertical wall portion substantially defining a second upper surface along a second side of the wall block, the second vertical wall portion and second horizontal wall portion each having a similar wall thickness and length to the wall thickness and length of the first longitudinally extending wall;

a first rib connected between the first longitudinally extending wall and the second longitudinally extending wall spaced a distance from first corresponding ends of the first and second longitudinally extending walls and forming a first opening between the first and second longitudinally extending walls and the first rib; and a second rib connected between the first longitudinally extending wall and the second longitudinally extending wall spaced a distance from second corresponding ends of the first and second longitudinally extending walls forming a second opening between the first and second longitudinally extending walls and the second rib and forming a hollow space defined by the first and second longitudinally extending walls and the first and second ribs.

16. The wall block of claim 15, wherein the second rib is spaced a distance from second corresponding ends of the first and second longitudinally extending walls to form a second opening between the first and second longitudinally extending walls and the second rib.

17. The wall block of claim 15, wherein the second rib is attached to second corresponding ends of the first and second longitudinally extending walls to form an end wall of the wall block.

18. The wall block of claim 15, wherein a first inner surface of the first horizontal wall portion between the first rib and the first corresponding ends of the first and second longitudinally extending walls is outwardly tapered and a second inner surface of the second horizontal wall portion between the second rib and the second corresponding ends of the first and second longitudinally extending walls is outwardly tapered.

19. The wall block of claim 18, wherein a width of each of the first horizontal wall portion and the second horizontal wall portion is 1/10-1/4 of a width of the hollow space.

20. The wall block of claim 15, wherein the second horizontal wall portion inwardly depends from the second longitudinally extending wall between the first rib and the first corresponding end of the second longitudinally extending wall.

21. The wall block of claim 15, further comprising first and second protrusions arranged on one side of the wall block on at least one of the first and second upper surfaces of at least one of the first and second longitudinally extending walls; first and second recesses arrange on an opposite side of the wall block on a lower surface of at least one of the first and second longitudinally extending walls to engage with at least one of the first and second protrusions of another wall block stacked on the wall block.

22. The wall block of claim 15, wherein a first longitudinal strengthening rib extending along a length direction of the wall block is arranged inside the first longitudinally extending wall, a second longitudinal strengthening rib extending along the length direction of the wall block is arranged inside the second longitudinally extending wall, a first transverse strengthening rib extending along a width direction of the wall block is arranged inside the first rib and a second strengthening rib extending along the width direction of the wall block is arranged inside the second rib, the first and second longitudinal strengthening ribs and the first and second transverse strengthening ribs being fixedly connected or integrally formed.

23. The wall block of claim 15, wherein the wall block is formed by solidification of a material combination, the material combination comprising silicon sand, cement, water reducing agent, re-dispersible emulsion powder, fiber and water; wherein with respect to the cement whose content is 100 parts by weight, the silicon sand content is 250-2000 parts by weight, the water reducing agent content is 0.5-3.0 parts by weight, the re-dispersible emulsion powder content is 0.1-10 parts by weight, the fiber content is 0.1-10 parts by weight, and the water content is 15-50 parts by weight.

24. The wall block of claim 23, wherein the fiber is selected from at least one of synthetic fiber, inorganic fiber, mineral fiber and plant fiber where the fiber length is 1-30 mm, and the average diameter is 0.1-100 μm; where the re-dispersible emulsion powder comprises at least one of a copolymerized emulsion powder of vinylacetate and ethylene, a terpolymerized emulsion powder of ethylene, vinyl chloride and vinyl laurate, a copolymerized emulsion powder of acrylic ester and styrene, and a copolymerized emulsion powder of styrene and butadiene; where a weight-average molecular weight of the re-dispersible emulsion powder is 500-20000, and the average particle diameter is 1-300 μm; where an average particle diameter of the silicon sand is 10-500 μm; the reducing water agent is comprised of at least one of lignosulfonate, polycyclic aromatic salt and water soluble resin sulfonate.

* * * * *